US012790773B2

(12) United States Patent
Anderson

(10) Patent No.: US 12,790,773 B2
(45) Date of Patent: Nov. 10, 2026

(54) PAVING MATERIAL AGITATION AND DISTRIBUTION BAR SYSTEM

(71) Applicant: Caterpillar Paving Products Inc., Brooklyn Park, MN (US)

(72) Inventor: Bradley D Anderson, Rogers, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 568 days.

(21) Appl. No.: 18/240,043

(22) Filed: Aug. 30, 2023

(65) Prior Publication Data

US 2025/0075445 A1 Mar. 6, 2025

(51) Int. Cl.
*E01C 19/48* (2006.01)

(52) U.S. Cl.
CPC ..... *E01C 19/486* (2013.01); *E01C 19/4886* (2013.01); *E01C 2301/16* (2013.01)

(58) Field of Classification Search
CPC ..... E01C 19/486; E01C 19/4886; E01C 19/4833; E01C 19/4846; E01C 19/4853; E01C 19/4873; E01C 19/4893; E01C 2301/16
See application file for complete search history.

(56) References Cited

U.S. PATENT DOCUMENTS 1,720,377 A * 7/1929 Pope ..... E01C 19/42 404/116
2,589,256 A * 3/1952 Horning ..... E01C 19/4873 404/101
2,589,257 A * 3/1952 Horning ..... E01C 19/4873 404/113
2,591,502 A * 4/1952 Bohannan ..... E01C 19/4873 404/84.2
3,767,312 A * 10/1973 Raymond ..... B28B 1/084 404/106
4,572,704 A 2/1986 Allen
6,183,160 B1 2/2001 Tapio et al.
6,238,135 B1 * 5/2001 Rower ..... E01C 19/48 404/133.05
7,591,607 B2 9/2009 Hall et al.
9,663,906 B2 5/2017 Dahm et al.
10,246,834 B1 * 4/2019 Ellwein ..... E01C 19/48
11,078,634 B2 8/2021 Taran
2002/0106242 A1 * 8/2002 Rahn ..... E01C 19/4893 404/96
2020/0277742 A1 * 9/2020 Mahler ..... E01C 19/48
2020/0378074 A1 * 12/2020 Frelich ..... E01C 19/42

FOREIGN PATENT DOCUMENTS

CA 3035671 C * 3/2020 ..... E01C 19/4853

* cited by examiner

*Primary Examiner* — Abigail A Risic

(57) ABSTRACT

A compaction assembly can move in a direction of motion over particulate material. The compaction assembly can include a reciprocable agitating portion positioned along an axis perpendicular to the direction of motion. The agitating portion can move laterally along the axis and to agitate the material transverse to the direction of motion. The compaction assembly can further include a screed plate mounted behind the agitating portion with respect to the direction of motion, the screed plate configured to smooth the material.

20 Claims, 7 Drawing Sheets

PAVING MATERIAL AGITATION AND DISTRIBUTION BAR SYSTEM

TECHNICAL FIELD

The present disclosure generally relates to an asphalt paving machine. More particularly, the present disclosure relates to a paving machine having an asphalt agitation system.

BACKGROUND

Paving machines are used to apply, spread and compact paving material relatively evenly over a desired surface. These machines are regularly used in the construction of roads, parking lots and other areas where a smooth durable surface is required for cars, trucks and other vehicles to travel. An asphalt paving machine generally includes a screed plate to smooth and compact the asphalt material and ideally leaves a roadbed of uniform depth and smoothness.

Current screed systems focus on compacting asphalt material to create structurally sound road mats. This may be done either using a tamper bar system that moves vertically (up and down) or by a vibration system. Passive compaction can be achieved with the weight of the screed. In such systems, individual material particles are only actively moved vertically to provide compaction. This can lead to air voids in the material resulting in suboptimal results such as crushed aggregate or improperly inter-locked aggregate. Vibration can provide some side-to-side action but is more passive in nature and may not occur according to predictable and desired patterns. The quality of the paving job can be improved on many jobsites by actively moving the asphalt in an intentional manner to organize aggregate in a predictable, desired way, resulting in stronger, more dense asphalt mats.

U.S. Pat. No. 6,183,160 provides a screeding assembly that includes a rotatable auger to move material laterally across the path of travel, a vibratory screed positioned behind the auger to smooth and finish the material, and an elongated engaging member reciprocated laterally across the path at a position between the auger and vibratory screed to facilitate consolidation of the material.

SUMMARY

In an example according to this disclosure, a compaction assembly can be configured to move in a direction of motion over particulate material. The assembly can include a reciprocable agitating portion positioned along an axis perpendicular to the direction of motion, the agitating portion configured to move laterally along the axis and to agitate the material transverse to the direction of motion; and a screed plate mounted behind the agitating portion with respect to the direction of motion, the screed plate configured to smooth the material.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
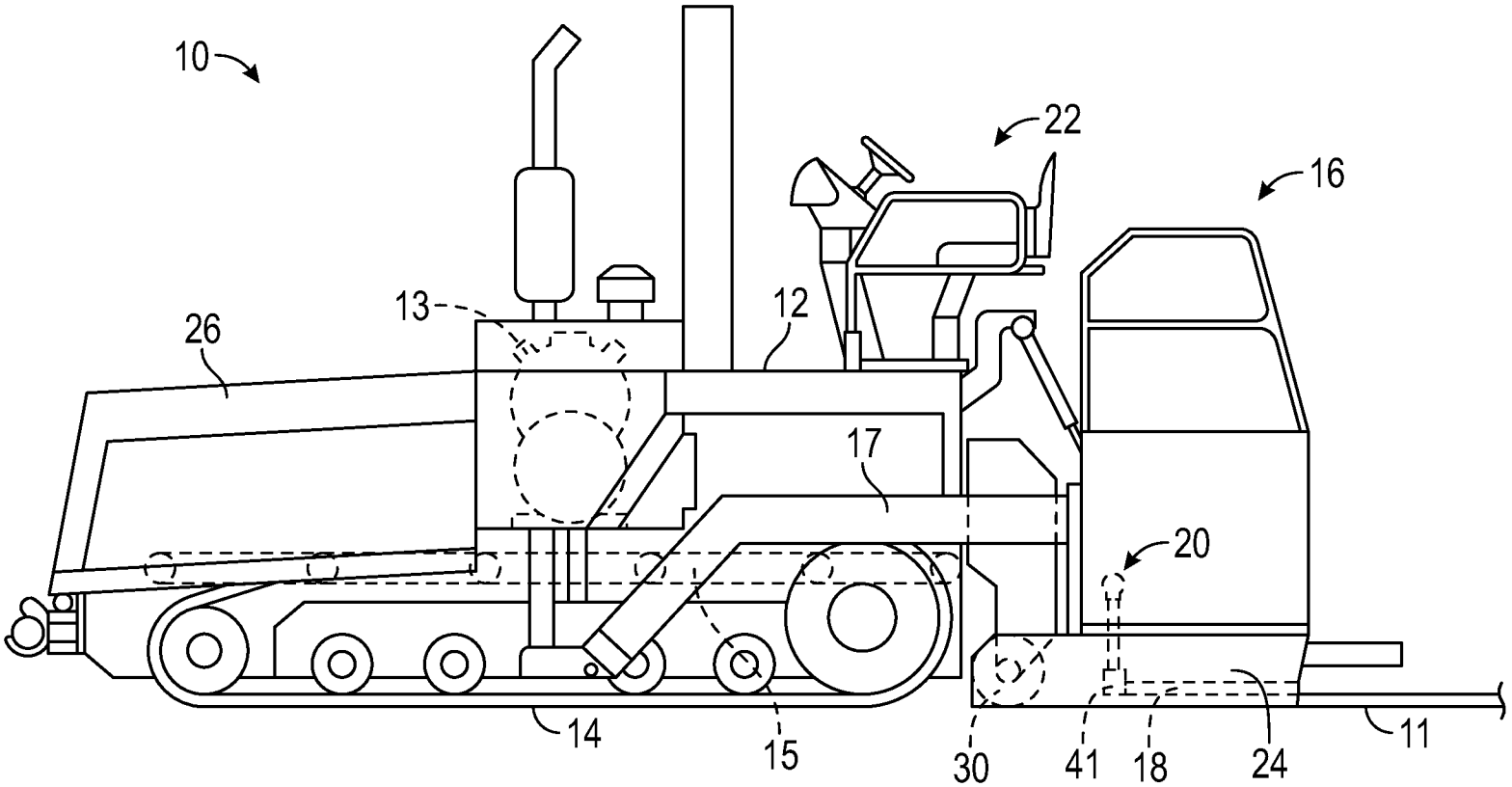
FIG. 1 shows a side view of a paving machine, in accordance with one embodiment.

FIG. 1 shows a side view of a paving machine 10 in accordance with one embodiment. The paving machine 10 generally includes a frame 12 with a set of ground-engaging elements 14 such as tracks or wheels coupled with the frame 12. The ground-engaging elements 14 may be driven by an engine 13 in a conventional manner. A screed assembly 16 can be positioned at the rear end of the paving machine 10 to spread and compact paving material into an asphalt mat 11 having a desired thickness, size, uniformity, crown profile and cross slope. The paving machine 10 also includes an operator station 22 having a seat and a console, which includes various controls for directing operations of the paving machine 10. Additional screed assemblies (e.g., screed extensions) can be provided to one or both sides of the paving machine 10 but are not shown in FIG. 1 for the sake of clarity.

The paving machine 10 further includes a hopper 26 for storing a paving material, and a conveyor system including one or more conveyors 15 configured to move paving material from the hopper 26 to the screed assembly 16 at the rear of the paving machine 10. One or more augers 30 are arranged near the forward end of the screed assembly 16 to receive the paving material supplied by the conveyor 15 and spread the material evenly beneath the screed assembly 16.

Reference to the "forward" end of the screed assembly 16 means the end of screed assembly 16 facing in the direction of travel of paving machine 10 as paving machine 10 is applying the paving material to a surface (to the left in FIG. 1). Similarly, reference to a "forward-facing" surface of a component of screed assembly 16 means a surface facing in the direction of travel of paving machine 10 while paving machine 10 is applying paving material to a surface, while reference to an "aft-facing" surface of a component means a surface facing away from the direction of travel of paving machine 10 while paving machine 10 is applying paving material to a surface (to the right in FIG. 1).

The screed assembly 16 can be pivotally coupled behind the paving machine 10 by a pair of tow arms 17 that extend between the frame 12 of the paving machine and the screed assembly 16. The tow arms 17 can be pivotally connected to the frame 12 such that the relative position and orientation of the screed assembly 16 relative to the screed frame and to the surface being paved may be adjusted by pivoting the tow arms 17, for example, in order to control the thickness of the paving material deposited by the paving machine 10.

The screed assembly 16 can include a screed frame 24 with a screed plate 18 coupled to the screed frame 24. The screed plate 18 is configured to float on the paving material of the asphalt mat 11 laid upon a prepared paving bed and to "smooth" or level and compact the paving material on the base surface, such as for example a roadway or roadbed.

The screed assembly 16 can include a tamper bar assembly 20 positioned forward of the screed plate 18 and extending transversely to the direction of travel of the paving machine 10. The tamper bar assembly 20 may include a tamper bar 41. Tamper bar assembly 20 can be coupled to the screed frame 24 of screed assembly 16 and configured such that the tamper bar 41 is reciprocated in an upward and downward direction substantially perpendicular to the asphalt mat 11 and substantially perpendicular to the direction of travel of paving machine 10. Tamper bar 20 extends generally transverse to the paving direction over substantially the entire width of the screed plate 18. The tamper bar assembly 20 pre-compacts the paving material as the paving machine 10 moves forward and the screed assembly 16 smooths the paving material to remove air pockets and other voids to create a flat, paved surface.

Thus, assemblies and systems according to embodiments can provide, instead of or in addition to tamper bar assemblies, a compaction assembly to move in a direction of travel (e.g., direction of motion) over particulate material. A partial view of the assembly is shown in FIG. 2, FIG. 3A and FIG. 3B.

Figure 2:
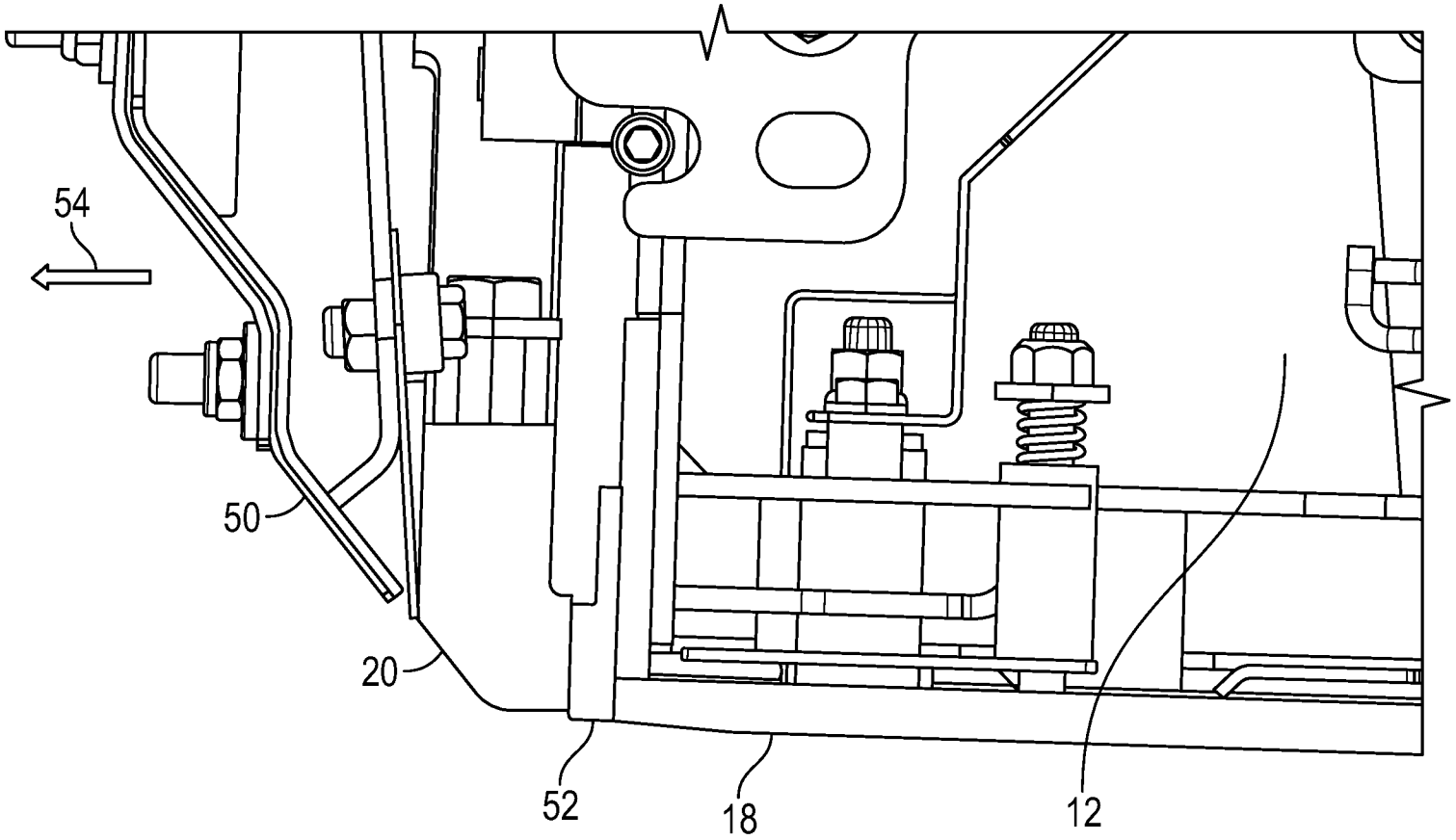
FIG. 2 shows a side view of a portion of a compaction assembly, in accordance with one embodiment.

FIG. 2 shows a side view of a portion of a compaction assembly, in accordance with one embodiment. As shown in FIG. 2, a deflector plate 50 includes a bottom edge, and the tamper bar 20 is disposed near the bottom edge (e.g., laterally toward the central axis and aft of the bottom edge) of the deflector plate 50. As described earlier herein, the tamper bar 20 is configured to move up and down vertically to pre-compact paving material. Also, a wear bar 52 may be disposed laterally adjacent to the tamper bar 20. The wear bar 52 is hard-mounted to the frame 12 and has no movement relative to the frame 12. The leading edge of the screed plate 18 abuts the rear surface of the wear bar 52. Because they are both hard-mounted to the frame 12, the screed plate 18 and wear bar 52 have no relative motion between each other.

Figure 3A:
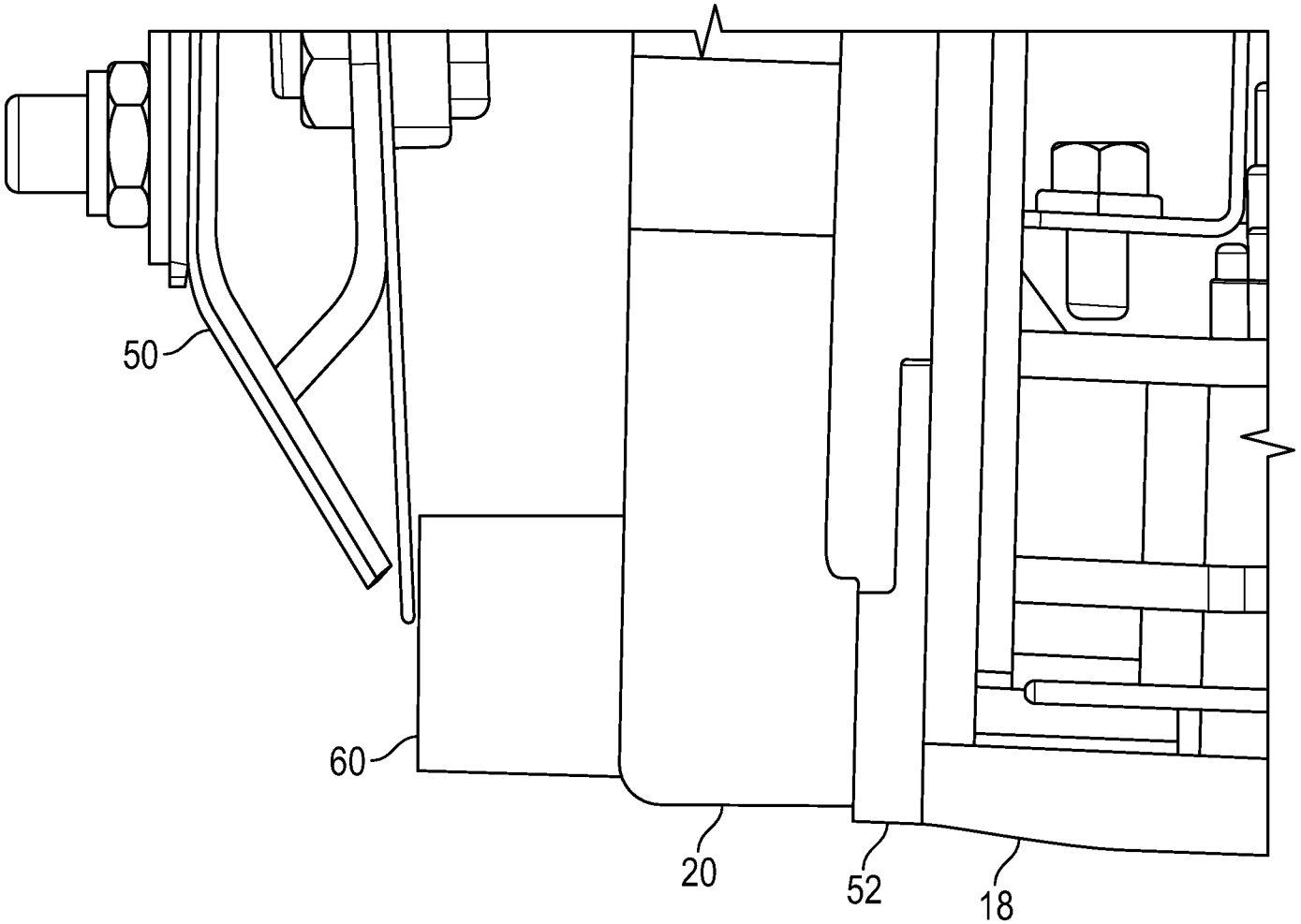
FIG. 3A shows side view of a portion of a first compaction assembly to show agitating portion placement, in accordance with one embodiment.

FIG. 3A shows a side view of a portion of a first compaction assembly to show agitating portion 60 placement, in accordance with one embodiment. The reciprocable agitating portion 60 can be positioned along an axis perpendicular to the direction of motion (axis 54 (FIG. 2). The agitating portion 60 can move laterally along the axis to agitate the material transverse to the direction of motion 54. As shown in FIG. 3A, the screed plate 18 is mounted behind the agitating portion 60 with respect to the direction of motion although in some embodiments the screed plate 18 may not be directly connected to or abut the agitating portion 60. For example, as shown in FIG. 3A, tamper bar 20 and wear bar 52 may be disposed between the agitating portion 60 and the screed plate 18. When screed extensions are included, the agitating portion 60 can be similarly situated respective to relevant screed plates (not shown in FIG. 3A).

Figure 3B:
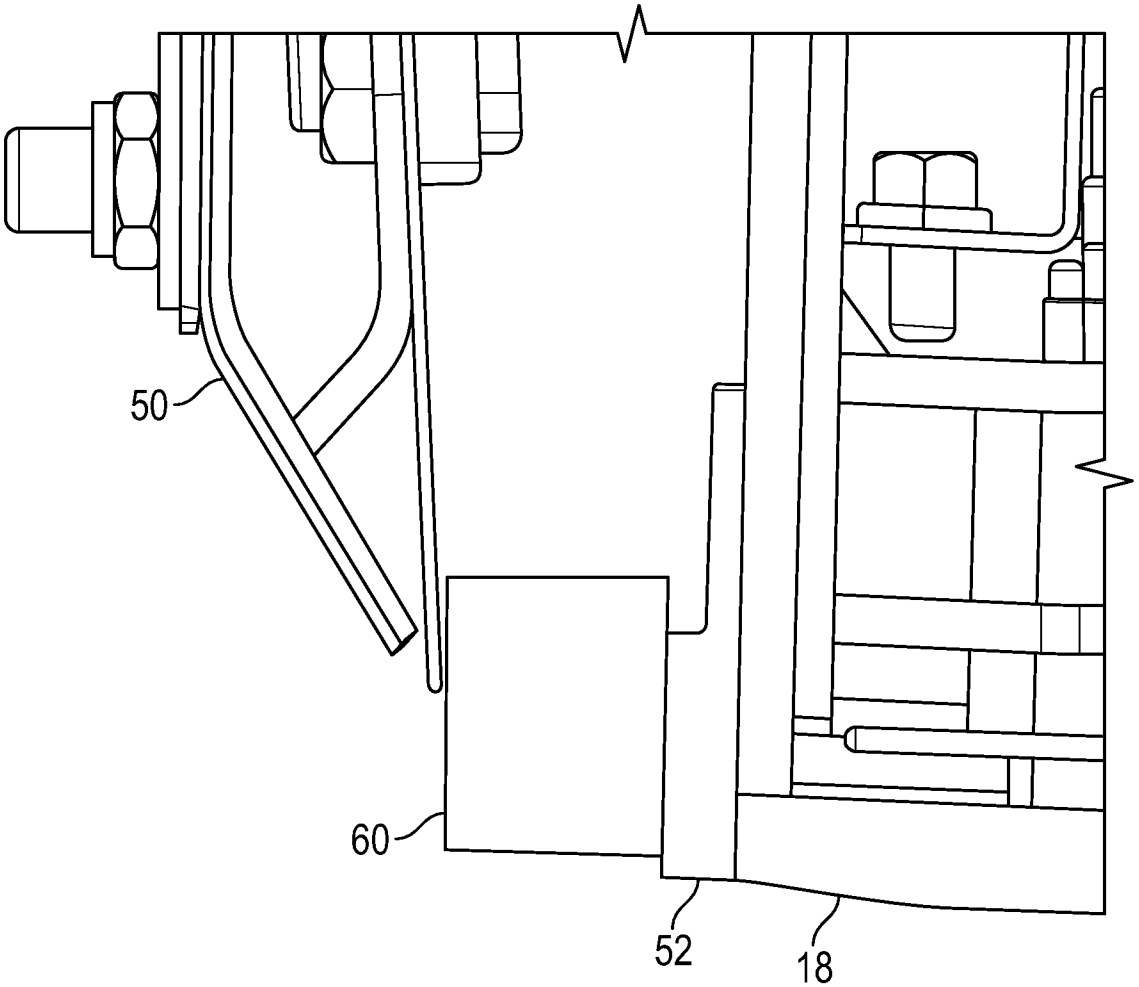
FIG. 3B shows side view of a portion of a second compaction assembly to show agitating portion placement, in accordance with one embodiment.

FIG. 3B shows a side view of a portion of a second compaction assembly to show agitating portion 60 placement, in accordance with one embodiment. As seen in FIG. 3B, tamper bar 20 is not present, and the agitating bar 60 can abut or nearly abut wear bar 52. As in FIG. 3A, the reciprocable agitating portion 60 is positioned along an axis perpendicular to the direction of motion (axis 54 (FIG. 2). The agitating portion 60 can move laterally along the axis to agitate the material transverse to the direction of motion 54. When screed extensions are included, the agitating portion 60 can be similarly situated respective to relevant screed plates (not shown in FIG. 3B).

Figure 4A:
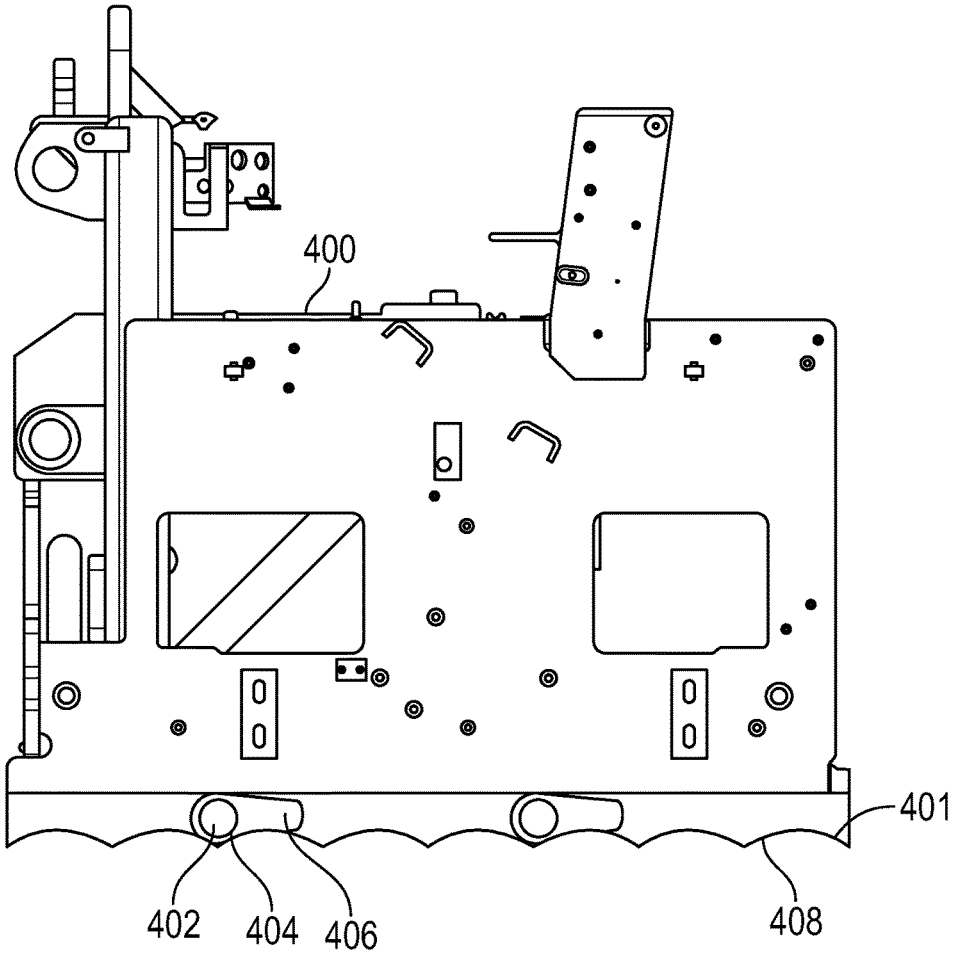
FIG. 4A shows a front view of a screed assembly to show mounting arrangement of components, in accordance with one embodiment.
Figure 4B:
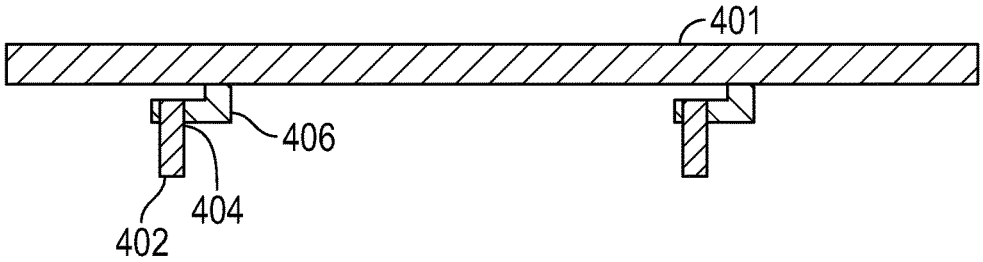
FIG. 4B shows a top view of a screed assembly to show mounting arrangement of components, in accordance with one embodiment.
Figure 4C:
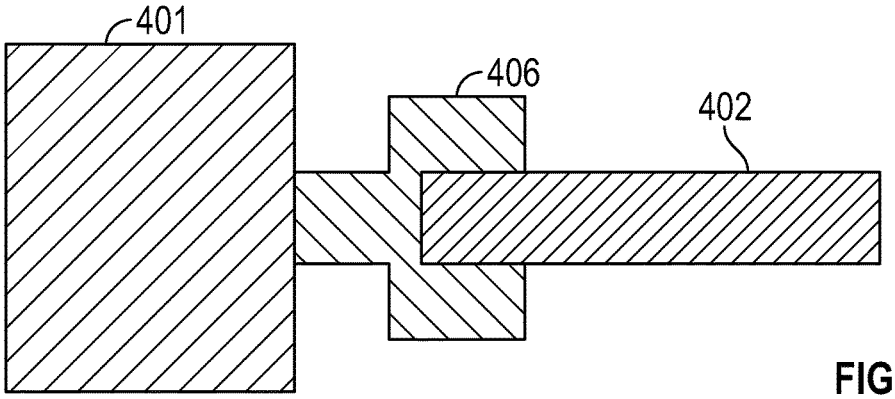
FIG. 4C shows a side view of a screed assembly to show mounting arrangement of components, in accordance with one embodiment.

Motion of the agitating portion 60 can be achieved using a shaft (e.g., an eccentric shaft) or any other device used to move a bar back and forth along a path. FIGS. 4A, 4B and 4C illustrates mounting configurations for shafts and shaft assemblies for actuating the agitating portion 60.

FIG. 4A shows a front view of compaction assembly to show mounting arrangement of components, in accordance with one embodiment. As shown in FIG. 4A, the agitating portion 401 is connected to the screed frame 400 with an agitating portion connecting rod 406. Agitation force is provided to the agitating portion 401 using a motor shaft 402 (which may be eccentric although embodiments are not limited thereto) and a hub 404 connected to the agitating portion connecting rod 406. Connections or linkages can include hydraulic cylinders, linear actuators, or other mechanisms. Actively and intentionally moving the aggregate left to right can reduce or eliminate air voids that may not completely be removed during compaction actions of the screed frame 400 or of the asphalt rollers.

The agitating portion 401 includes a surface 408 for contact with the material (e.g., aggregate, asphalt, etc.). The topographical geometry of the surface 408 should provide surfaces capable of pushing material horizontally relative to the work surface, such that the bottom surface of the agitating portion 401 can actively interact with asphalt mix, aggregate etc. by pushing the material horizontally to-and-fro (e.g., left to right although embodiments are not limited thereto). The surface 408 can include a plurality of recesses and projections, which can take different shapes such as scalloped shapes, triangular shapes, completely flat, etc. For example, FIG. 4A depicts recesses and projections on surface 408 that include curves or scallops. The curve or recess diameters can be set based on the size, type and dimensions of the material and can be the same diameter or different diameter. The diameter of surface 408 features (or the height of surface 408 features) can be set based on testing of different heights/diameters with various common paving materials. In examples, the diameters or heights will be less than the height of large pieces of paving material (e.g., about 50-80% the size of typical pieces of asphalt/aggregate). In examples, the agitating portion 401 can be removable and replaceable with other agitating portions of having surface features of different size/diameter to adjust for different materials. The surface 408 can be comprised of a wear-resistant material. In examples, the wear-resistant material can include a material with a high chrome content although embodiments are not limited thereto. In examples, the wear-resistant material includes a high chrome white iron that can be cast. Alternatively, a machined or forged bar stock that is subsequently heat treated to improve wear performance could be used.

Figure 5A:
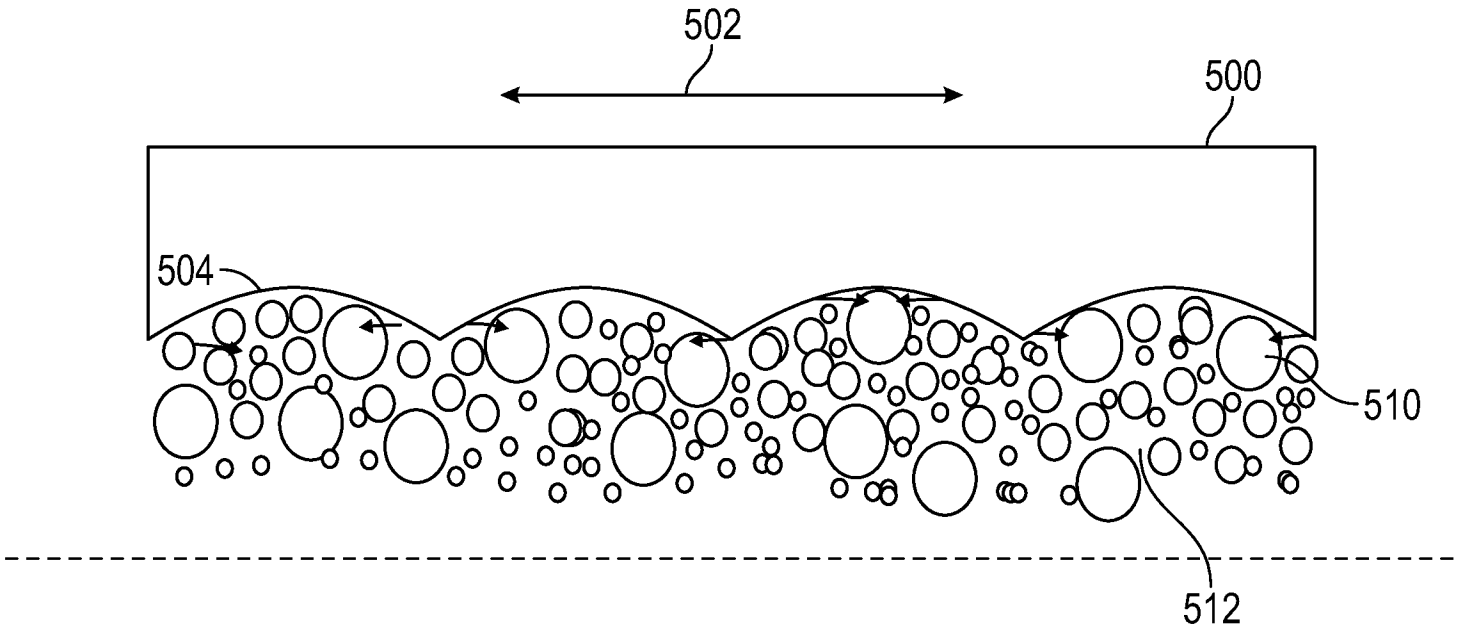
FIG. 5A illustrates agitating portion motion in a direction over aggregate.
Figure 5B:
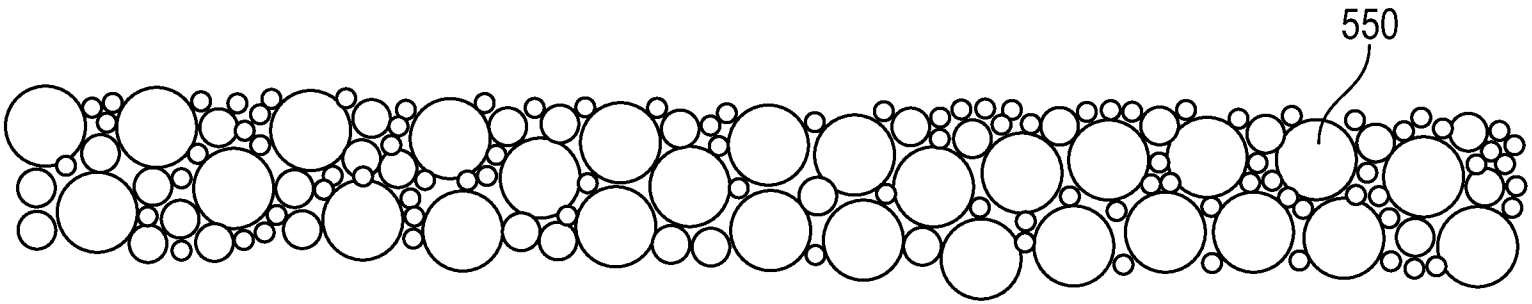
FIG. 5B illustrates aggregate after agitation in accordance with one embodiment.

FIG. 5A illustrates agitating portion 500 motion in a direction 502. Shapes (e.g., scallops 504) move aggregate side-to-side. As seen in FIG. 5A aggregate 510 is relatively loose and un-compacted, and includes multiple spaces, gaps, or air voids 512. Compaction according to available systems would merely press the aggregate 510 down, which could result in some air voids 512 remaining. In contrast, FIG. 5B illustrates aggregate 550 after the agitating portion 500 has moved aggregate 550 side to side, allowing more pieces to move into a favorable position and providing an improved inter-locking structure with fewer or no air voids.

Referring now to FIG. 4B, FIG. 4B shows a top view of a screed assembly to show mounting arrangement of components, in accordance with one embodiment. For example, as shown the connecting rod 406 can hold the motor shaft 402 a distance from the agitating portion 401. FIG. 4C shows a side view of a screed assembly to show mounting arrangement of components, in accordance with one embodiment. As shown, the agitating portion 401 is connected to the motor shaft 402 through a connecting rod 406 and hub 404 mechanism.

Figure 6:
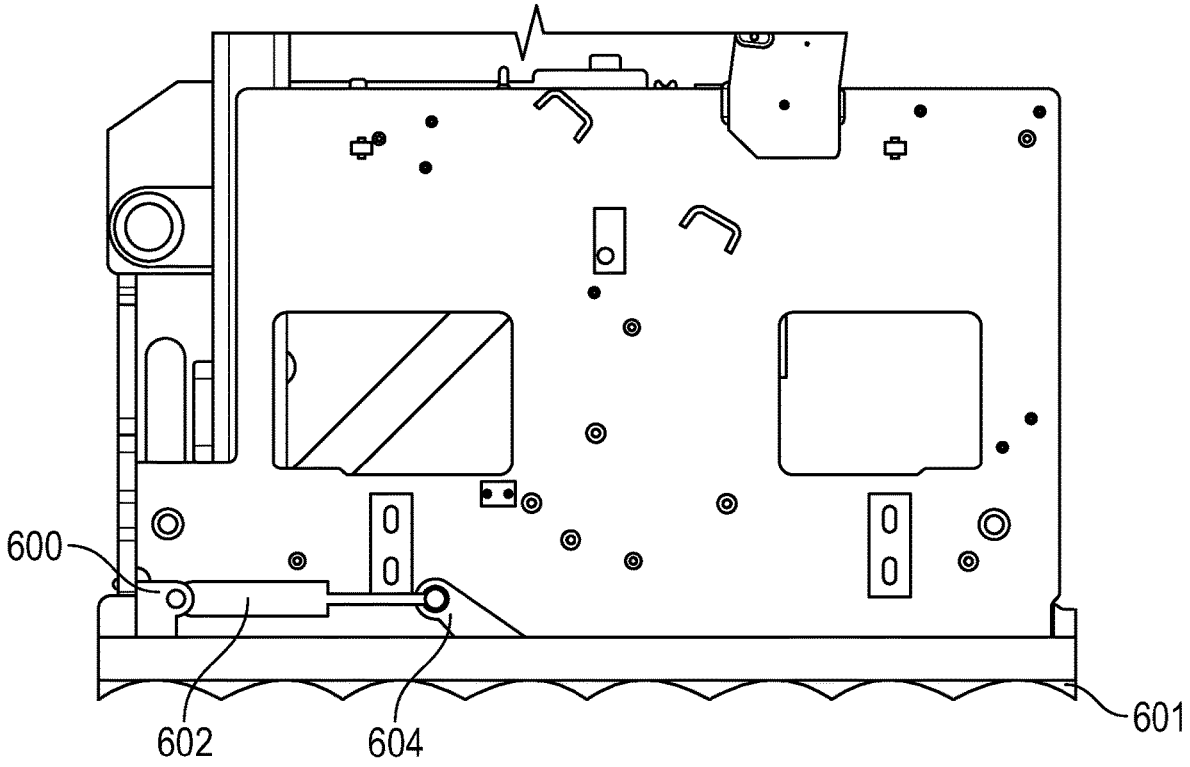
FIG. 6 shows an alternative front view to show mounting of a connection assembly, in accordance with one embodiment.

FIG. 6 shows an alternative front view to show mounting of a connection assembly, in accordance with one embodiment. An actuator 602 can be mounted at point 600 include a hydraulic cylinder or electric linear actuator that extends and retracts to create the desired motion in the agitating portion 601. The actuator 602 can be used in place of the motor described above with reference to FIG. 4A-4C in conditions where vibrations or movement are at lower frequencies. A connection 604 can be provided between the agitating portion 601 and the actuator 602. While motor shafts and actuators are described, other components for creating motion or vibration can be used to input motion to the compaction assemblies of various embodiments.

By providing agitating portions as described herein in accordance with various embodiments, density and strength of asphalt mat can be improved. Air voids and other gaps can be removed from asphalt or other material, providing interlocking stability throughout an asphalt mat. Furthermore, assemblies according to embodiments provide higher densities and smoother surfaces of the final asphalt mat.

INDUSTRIAL APPLICABILITY

The present system is applicable to paving systems that include screeds for creating structurally sound road mats. As noted, although compaction occurs with these paving systems, air voids or other gaps may be left in road mats, reducing strength of those road mats.

Here, the system provides a device to agitate paving material (e.g., aggregate) to cause improved interlocking of particles. An agitating portion can be connected to a motor or other movement-generating device to move the agitating portion laterally traverse to a direction of movement of a paving system. Particles or pieces of the aggregate can then vibrate or slide into an improved interlocking position, providing a reduction in air voids in road mat resulting in increased density and smoothness.

The above detailed description is intended to be illustrative, and not restrictive. The scope of the disclosure should, therefore, be determined with references to the appended claims, along with the full scope of equivalents to which such claims are entitled.

I claim:

1. A compaction assembly configured to move in a direction of motion over particulate material, the assembly comprising:

a reciprocable agitating portion positioned along an axis perpendicular to the direction of motion, the agitating portion configured to move laterally along the axis and to agitate the material transverse to the direction of motion of the compaction assembly by way of a contact surface for reciprocating contact with the material according to the lateral movement of the agitating portion; and a screed plate mounted behind the agitating portion with respect to the direction of motion, the screed plate configured to smooth the material, wherein a surface profile of the contact surface includes a plurality of recesses and projections, and wherein the contact surface faces directly downward, perpendicular to the direction of motion of the compaction assembly, such that portions of the recesses face directly downward.

2. The assembly of claim 1, wherein the agitating portion is connected to a motor shaft and a hub with an agitating portion connecting rod, and wherein agitation force is provided to the agitating portion using the motor shaft and the hub.

3. The assembly of claim 2, further including a wear bar between the agitating portion and a screed frame.

4. The assembly of claim 1, wherein the agitating portion is connected to a linear actuator with an agitating portion connecting rod, and wherein agitation force is provided to the agitating portion using the linear actuator.

5. The assembly of claim 1, further comprising a tamper bar assembly positioned between the agitating portion and the screed plate, the tamper bar assembly including:

a tamper connecting rod configured to have a vertical reciprocating motion; and a tamper bar positioned beneath the plate, to compact the material subsequent to the agitation of the material.

6. The assembly of claim 1, wherein a tamper bar is configured to move vertically with respect to the direction of motion.

7. The assembly of claim 1, wherein a bottom-most portion of the agitating portion is at a height above a bottom-most portion of the screed plate.

8. The assembly of claim 1, wherein the recesses include curves.

9. The assembly of claim 8, wherein the recesses include curves of a same diameter corresponding to a type or size of the material.

10. The assembly of claim 8, wherein a height of at least one projection is based on particle dimensions of the material, a type of the material, or material particle dimensions.

11. A screed assembly comprising:

a main screed portion including:

an agitating portion positioned along an axis perpendicular to a direction of motion, the agitating portion configured to move laterally along the axis and to agitate a material transverse to the direction of motion;

a screed plate mounted behind the agitating portion with respect to the direction of motion, the screed plate configured to smooth the material;

a wear bar between the agitating portion and the screed plate, the wear bar being directly connected to a front portion of the screed plate; and a tamper bar assembly configured to move vertically with respect to the direction of motion, wherein the tamper bar assembly is between the agitating portion and the wear bar with respect to the direction of motion, and wherein the agitating portion is in front of and in direct contact with a front portion of the tamper bar with respect to the direction of motion.

12. The screed assembly of claim 11, wherein the agitating portion is connected to a motor shaft and a hub with an agitating portion connecting rod, and wherein agitation force is provided to the agitating portion using the motor shaft and the hub connected to the agitating portion connecting rod.

13. The screed assembly of claim 11, wherein agitation force is provided to the agitating portion using a linear actuator.

14. The screed assembly of claim 11, wherein the agitating portion includes a first surface for contact with the material, and wherein the first surface includes a plurality of recesses and projections.

15. The screed assembly of claim 14, wherein the recesses include curves of a same diameter based on a type or size of the material and a height of at least one projection is based on particle dimensions of the material.

16. The screed assembly of claim 11, further including at least one extension screed portion positioned laterally from the screed plate.

17. A method comprising:

agitating the paving material along an axis perpendicular to a direction of motion of a work machine using an agitating portion configured to move laterally along the axis to agitate the material transverse to the direction of motion;

immediately after said agitating the paving material, tamping down the paving material using a tamper configured to move vertically with respect to the direction of motion; and smoothing the paving material using a screed plate subsequent to the agitating and the tamping down, wherein the agitating portion is in front of and in direct contact with a front portion of the tamper with respect to the direction of motion of the work machine.

18. The method of claim 17, wherein the agitating includes moving laterally along the axis to agitate the paving material transverse to the direction of motion.

19. The method of claim 17, wherein the agitating portion includes a first surface for contact with the paving material, wherein the first surface includes a plurality of recesses and projections, and wherein the recesses include curves of a same diameter based on a type or size of the material.

20. The assembly of claim 1, further comprising:

a wear bar between the agitating portion and the screed plate, the wear bar being directly connected to a front portion of the screed plate; and a tamper bar assembly configured to move vertically, wherein the tamper bar assembly is between the agitating portion and the wear bar with respect to the direction of motion, and wherein the agitating portion is in front of and in direct contact with a front portion of the tamper bar with respect to the direction of motion.

* * * * *